United States Patent [19]

Nishiura et al.

[11] 4,152,216

[45] May 1, 1979

[54] SEALING DEVICE FOR COKE OVEN DOORS

[76] Inventors: Taiji Nishiura, 2-35-1-1017, Minami-rokugou, Ohta-ku, Tokyo-to; Kazutomi Shimamura, 2-11-17, Sakuramoto Kawasaki-ku, Kawasaki-shi, Kanagawa-ken, both of Japan

[21] Appl. No.: 831,924

[22] Filed: Sep. 9, 1977

[30] Foreign Application Priority Data

Sep. 25, 1976 [JP] Japan ..... 51-129213
Jan. 27, 1977 [JP] Japan ..... 52-8741

[51] Int. Cl.[2] ..... C10B 25/06; C10B 25/16

[52] U.S. Cl. ..... 202/248; 49/466; 49/481; 49/484; 49/498; 202/269

[58] Field of Search ..... 202/242, 248, 269; 49/466, 480, 481, 484, 488, 490, 498; 220/378; 34/242

[56] References Cited

U.S. PATENT DOCUMENTS

| | | | |
|---|---|---|---|
| 2,038,051 | 4/1936 | Lymn | 202/248 |
| 2,442,391 | 6/1948 | Wilputte | 202/248 |
| 3,952,454 | 4/1976 | Sudo | 202/248 |
| 3,984,310 | 10/1976 | Calderon | 202/248 |
| 4,002,537 | 1/1977 | Calderon | 202/248 |
| 4,016,045 | 4/1977 | Van Ackeren | 202/248 |
| 4,016,046 | 4/1977 | Van Ackeren et al. | 49/484 |
| 4,032,409 | 6/1977 | Knappstein et al. | 202/248 |
| 4,033,828 | 7/1977 | Morrow et al. | 202/248 |

FOREIGN PATENT DOCUMENTS

| | | | |
|---|---|---|---|
| 2357488 | 5/1975 | Fed. Rep. of Germany | 202/248 |

*Primary Examiner*—Sidney Marantz
*Assistant Examiner*—Bradley R. Garris
*Attorney, Agent, or Firm*—Holman & Stern

[57] ABSTRACT

A device for sealing a steel door of a coke oven, the structure provides a sealing member disposed over the entire periphery of the steel door, said member closing the opening formed in the wall of the body of the coke oven. The sealing member includes a deformable covering material and a spring disposed within said covering material, the combination forming an elastic member, the deformable covering material being biased by the spring against the surface of the body of the coke oven about the periphery of the opening closed by the steel door, the sealing member being carried on the door. The invention further provides a deformable tar-receiving cover which prevents accumulation of tar between the door and the sealing member.

2 Claims, 5 Drawing Figures

SEALING DEVICE FOR COKE OVEN DOORS

BACKGROUND OF THE INVENTION

1. Field of the Invention

The invention generally relates to sealing devices for coke oven doors and more particularly to a sealing device which retains sealing properties during heat-induced distortion of such doors.

2. Description of the Prior Art

A common problem encountered in the operation of coke ovens involves leakage of gases and dust from the coke oven due to insufficient sealing between the steel doors of the oven and the side walls of the oven defining openings into said oven. Sudo, in U.S. Pat. Nos. 3,952,454 and 3,977,125, discloses devices for sealing steel doors of coke ovens, which devices include ring-shaped steel packings and ring-shaped elastic packing assemblies fitted over the outer surfaces of the door so as to contact side walls of the coke oven when the door is closed. Knife edges are usually provided by prior art sealing mechanisms, such mechanisms usually failing to provide a uniform seal about the full periphery of the door especially when distortion of the door and the body of the oven occurs due to the heat of the oven. And devices disclosed in the above U.S. Patents are not sufficient with regard to heat-resistance because the packing assemblies have rubber elements. The present invention provides the full advantages of the prior art, such as the prevention of the escape of internal gases and dust from the coke oven through gaps about the periphery of the door of the oven when the door is closed. The present invention additionally provides a door sealing device whereby the sealing effect not lost due to heat-induced distortion of the door and oven.

SUMMARY OF THE INVENTION

The present invention provides a device for sealing doors of a coke oven, the present device maintaining adequate sealing properties even on distortion of the coke oven door and the coke oven due to thermally-induced stress within said oven, the present sealing device further being heat-resistant and exceptionally durable. According to the invention, a sealing structure is secured about the periphery of the coke oven door, the sealing structure being formed of a deformable covering member, the deformable covering member housing upper and lower U-shaped frames having a spring disposed therebetween. The deformable covering member is preferably comprised of thin metallic plate material, such as could be formed of stainless steel. Portions of the covering member are biased by the spring against the surface of the oven body when the door is closed, thereby preventing gases internally of the oven from leaking between the steel door and the side walls of the oven defining the opening closed by said door. Deformation of the steel door or of the oven body due to thermally-induced stresses is accommodated by the ability of the spring to continuously maintain the covering member in contact with the surface of the oven body over the entire periphery of the door since the spring continuously biases the covering member against the surface of the oven body about the full periphery of the seal, a sealing effect being maintained despite normal distortion of the door and oven body. The effectiveness of sealing devices for coke oven doors is typically deteriorated by tars which form between the door and the sealing member, the tar having to be periodically removed manually in order to restore efficient sealing capability to the sealing device. The present invention further provides structure which reduces the accummulation of tar between the door and the sealing device.

Accordingly it is an object of the invention to provide a sealing device for maintaining a sealing effect about a door of a coke oven even though the door or oven body becomes distorted due to the heat of the oven.

It is another object of the invention to provide a device for sealing doors of a coke oven whereby leakage of gases and dust from the coke oven chamber into the surrounding atmosphere is prevented, an elastic sealing member of the present device being continuously biased against the surface of the oven body about the full periphery of the door.

It is a further object of the invention to provide a device for sealing doors of a coke oven whereby tar material normally accumulating between the coke oven door and a sealing device is prevented from gaining access between said door and said sealing device.

Further objects and advantages of the invention will become more readily apparent in light of the following detailed description of the preferred embodiments.

DESCRIPTION OF THE PREFERRED EMBODIMENTS

Figure 1:
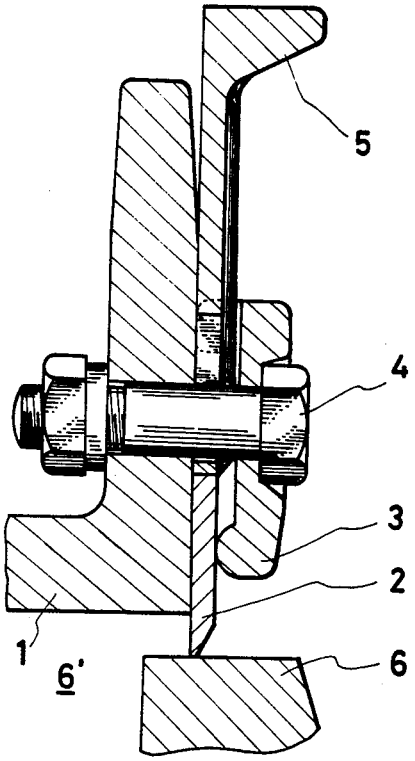
Fig. 1 (prior art)
FIG. 1 is an elevational view in section of a prior art sealing device for coke oven doors.

Referring now to the prior art sealing device of FIG. 1, a knife edge 2 is seen to be disposed at one side of a coke oven door 1, the knife edge being secured to said door by means of a clamping member 3 and a bolt 4. A striking tool 5 is adapted to be struck on an enlarged end portion thereof in order to bring a distal end portion of the knife edge 2 into close engagement with opposing surface portions of an oven body 6. This prior art device fails to provide a uniform sealing effect about the full periphery of the door, especially when the door and/or oven body are caused to be distorted due to the heat of the oven. When such heat-induced distortion occurs, the knife edge 2 becomes separated from the surface of the oven body 6, gaps between the sealing device and the oven body thus forming to allow escape of gases and dust.

Figure 2:
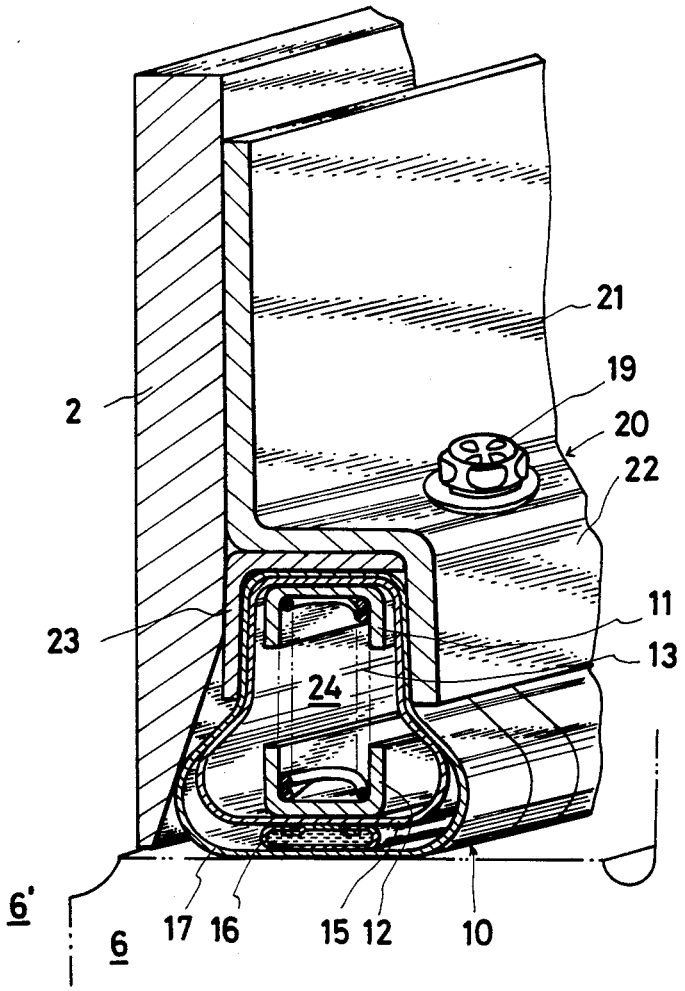
FIG. 2 is an oblique sectional view illustrating a door of a coke oven provided with a first embodiment of the sealing device which is partially improved but does not belong to the present invention.

As can be seen in FIG. 2, a sealing member 10 is secured to the door 1 (not shown in FIG. 2) adjacent to the knife edge 2, a retainer member 20 being used to hold the sealing member 10 in a desired relation to the knife edge 2 as will be explained hereinafter. The sealing member 10 comprises elastic inner and outer covering members 15 and 17, the members 15 and 17 being formed of a thin, plate-like material such as stainless steel which is deformable axially of the longitudinal axis of the sealing member 10. The inner covering member 15 houses U-shaped upper and lower frame members 11 and 12, a spring 13 being disposed within the channel formed by the frame members 11 and 12 and biasing against inner surface portions thereof. A plurality of the springs 13 are disposed within the sealing member 10 about the full periphery of the coke oven door. The sealing member 10 can be expanded by the force of the spring 13 in the direction opposite the end thereof held by the retainer member 20, the spring 13 being compressed and the inner and outer covering members 15 and 17 being axially deformed when the sealing member 10 is caused to abut the surface of the oven body 6 on closure of the oven door 1. The free end of the sealing member 10 is thus elastically compressed upon the surface of the coke oven body 6 for sealing engagement therewith. The free end of the inner covering member 15 has a gasket 16 secured thereto, the gasket 16 comprising a tube formed of thin metallic plate material filled with a heat-resistant material such as glass wool or asbestos. When the sealing member 10 is disposed relative to the oven body 6 in operative position as seen in FIG. 2, the gasket 16 is biased by the spring force exerted by the spring 13 on the inner covering member 15 to compress said gasket 16 between the members 15 and 17. Accordingly, the gasket 16 is caused to elastically maintain that portion of the outer covering member 17 contacting said gasket 16 in abutting relationship with the surface of the oven body 6 over a relatively wide portion of said surface. The spring 13 causes the sealing member 10 to maintain contact with the surface of the oven body 6 even though the door of the coke oven or the oven body 6 be deformed due to thermal stress.

The retainer member 20 comprises an attachment plate 21 which is disposed adjacent to the knife edge 2, an L-shaped retaining portion 22 extending from the attachment plate 21. The retainer member 20 cooperates with a groove member 23 to define a seal-receiving groove 24, the inner end of the sealing member 10 being received within the groove 24 and attached or fixed therein by suitable means such as attaching bolts 19. The attachment plate 21 can be secured to the coke oven door by means of the clamping member and bolt 4 as described in FIG. 1. Alternatively, the attachment plate 21 can be directly welded onto edge surfaces portions of the knife edge 2.

Figure 3:
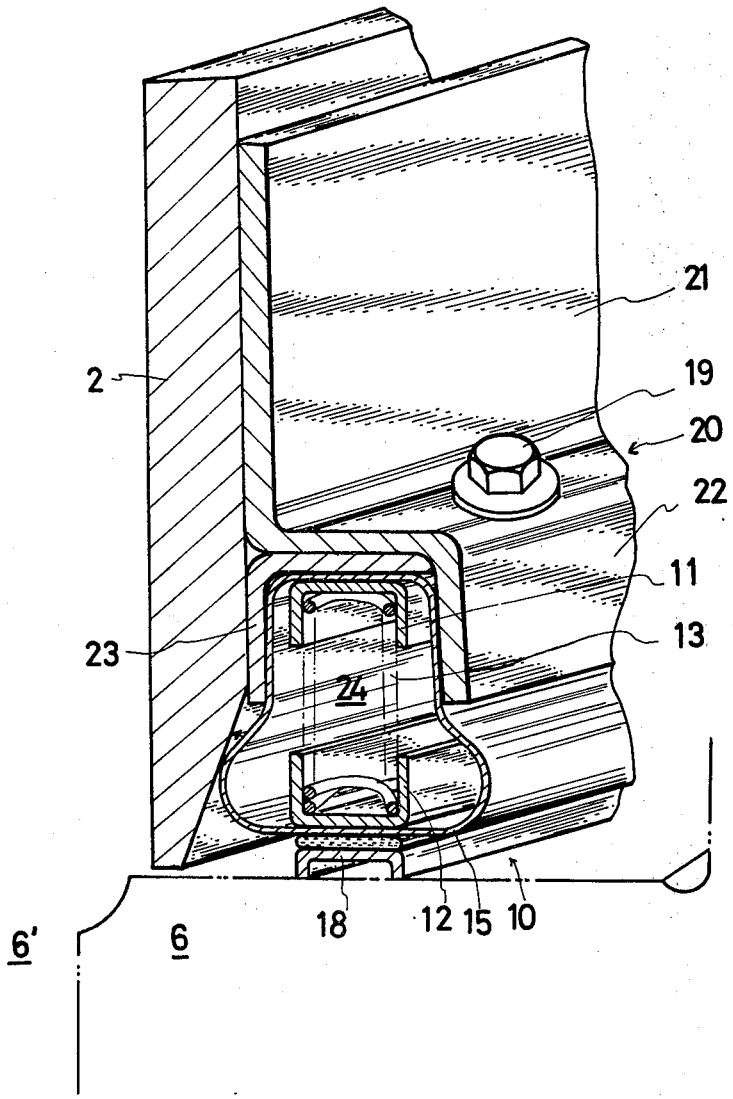
FIG. 3 is an oblique sectional view illustrating a door of a coke oven provided with a second embodiment of the sealing device which is also partially improved but does not belong to the present invention.

In the embodiment shown in FIG. 3, the sealing member 10 is formed without the outer covering member 17, the inner covering member 15 functioning to house the U-shaped frame members 11 and 12 and the spring 13. A seal member 18 formed of a metallic material and having an inverted U- or T-shaped section is fixed to the free end of the covering member, free edge portions of the seal member 18 extending outwardly from the sealing member 10 to engage against the surface of the oven body 6. The spring 13 biases the seal member 18 against the oven body 6.

The sealing members 10 of FIGS. 2 and 3 provide the capability to maintain sealing relation between the oven body 6 and the door 1 even upon deformation of either the oven body or the door due to thermally induced stress thereon. However, during operation of the coke oven tar components inevitably flow between the knife edge and the oven body 6, these tar materials accumulating and solidifying in the cavities defined by the knife edge 2, the sealing member 10, and the surface of the oven body 6. Deterioration of the sealing ability of the sealing member 10 thus occurs, the sealing ability of the member 10 being restored only by manual removal of the tar material. According to several embodiments of the invention which are to be described hereinafter, a side wall of the groove member 23 is extended to substantially reach to the end of the knife edge 2. This extended portion of the groove member 23 is covered by an L-shaped tar-receiving cover formed of a thin, metallic plate material which is deformable in the manner of the covering members 15 and 17.

Figure 4:
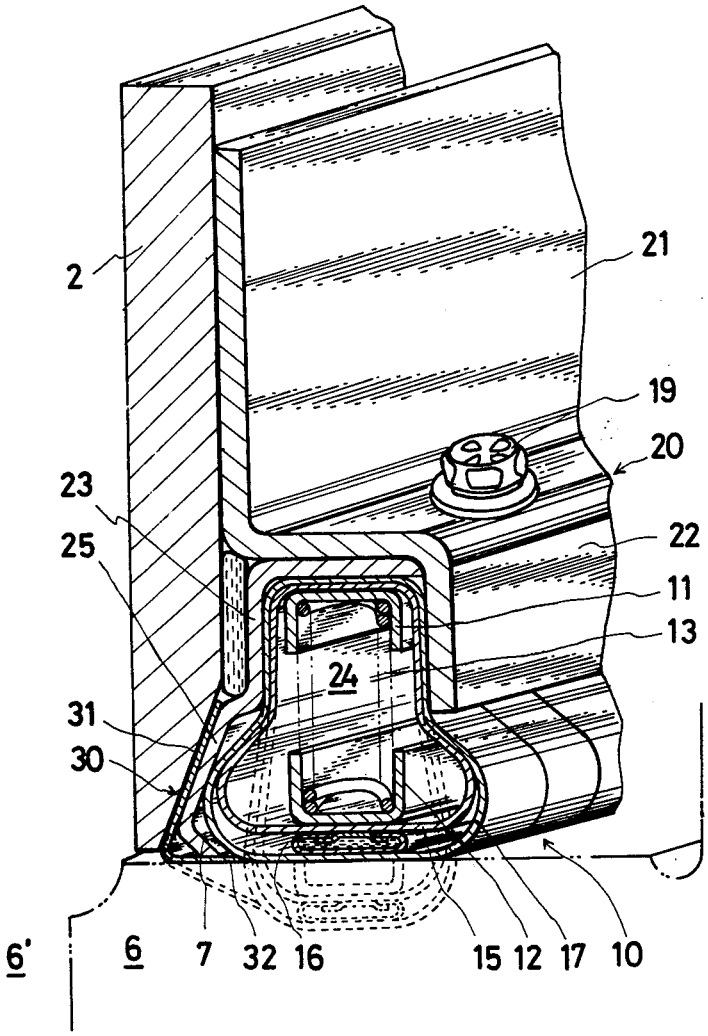
FIG. 4 is an oblique sectional view illustrating a sealing device according to the present invention and provided with a tar-receiving cover.

Referring particularly to FIG. 4, the sealing member 10 is formed as described relative to FIG. 2, the groove member 23 having a skirt portion 25 extending therefrom toward the distal end portion of the knife edge 2. This skirt portion 25 is disposed essentially parallel to and spaced from inclined surface portions of the knife edge 2, a tar-receiving cover 30 being partially disposed between said knife edge 2 and said skirt portions 25. The tar-receiving cover 30 comprises an inclined plate portion 31 and a flat plate portion 32, the inclined plate portion 31 being disposed between said skirt portion and said knife edge 2. The inclined plate portion 31 is secured to the skirt portion 25 such as by welding, the tar-receiving cover 30 covering the skirt portion 25. The attachment plate 21 of the retainer member 20 is disposed contiguously against the surface of the body of the knife edge 2, the sealing member 10 received within the groove 24 and held by the retainer member 20 being thereby connected through the knife edge 2 to the coke oven door 1 as can be understood relative to FIG. 1. As seen in FIG. 4, the sealing member 10 is allowed to expand as shown by the broken lines when the door is open, the flat plate portion 32 of the tar receiving cover being also outwardly stretched when the door is open. When the door is closed, the sealing member 10 is compressed elastically as described hereinabove such that the gasket 16 presses surface portions of the outer covering member 17 against the surface of the oven body 6, thereby to seal the coke oven door and the oven body. The flat plate portion 32 of the tar receiving cover 30 is also resiliently bent such that the outer surface portion of the flat plate portion 32 is pressed against the surface of the oven body 6. The distal end of the flat plate portion 32 contacts the side of the outer covering member 17 to further seal against gas leakage from the coke oven and to simultaneously prevent tar material from flowing into the spaces 7 between the knife edge 2 and the sealing member 10.

Figure 5:
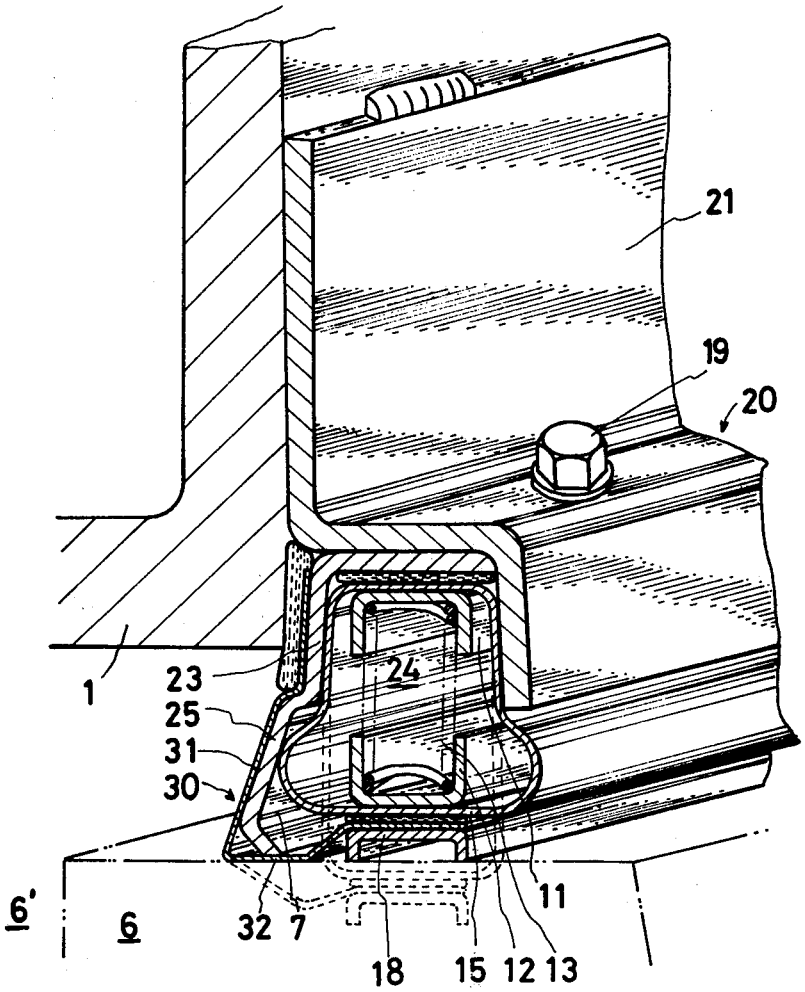
FIG. 5 is an oblique sectional view of a further embodiment of the invention.

In the embodiment of the invention shown in FIG. 5, the retainer member 20 is secured directly to the coke oven door 1, the knife edge 2 being omitted from the structure. While the sealing member 10 could take the form of the embodiment of FIG. 2 or of FIG. 3, the embodiment of FIG. 3 is shown for illustration. The groove member 23 is provided with the skirt portion 25 as described relative to FIG. 4. The tar receiving cover 30 is seen to have the flat plate portion 32 extended between the covering member 15 and the seal member 18, the tar-receiving cover thereby completely enclosing the skirt portion 25 of the groove member 23. The attachment plate 21 is directly connected to the coke oven door 1 such by welding, or by the use of clamping member 3 and bolt 4 as described relative to FIG. 1.

As shown in the broken lines in FIG. 5, the sealing member 10 and the tar-receiving cover 30 are resiliently biased outwardly by the spring 13 when the door 1 is open. When the door 1 is closed, the sealing member 10 is elastically compressed to bring the seal member 18 into sealing engagement with the surface of the oven body 6. The tar receiving cover 30 is also resiliently bent and compressed against the surface of the oven body 6 to prevent in cooperation with the sealing member 10 internal gases within the coke oven from leaking out of said oven. The tar receiving cover 30 further prevents tar materials from flowing from the coke oven into contact with the sealing member 10, the door 1 is spaced from the oven body 6 by the abutment of the skirt portion 25 with the surface of the oven body 6 through the flat plate portion 32. The skirt portion 25 thereby provides a dual function in preventing the flow of tar from the coke oven and in limiting excessive movement of the door 1.

It is to be understood that the invention may be practiced other than as specifically described hereinabove, the scope of the invention being limited only by the definition provided by the appended claims.

What is claimed is:

1. In a coke oven having a wall with a wall opening and a steel door for closing said opening, the improvement comprising a device for sealing said door including a knife edge member fitted over an outer surface of the door whereby a distal end of said knife edge member contacts a wall surface of the oven when the door is closed, said knife edge member having an outer surface including an inclined portion terminating at said distal end, a retainer member fitted over said outer surface of the knife edge member, an elastic sealing means held by the retainer member to press elastically against said wall surface when the door is closed and having elastic covering means and at least one spring means disposed to bias said covering means to extend in the direction of said wall surface, and a tar receiving cover means of substantially L-shaped cross section including an inclined plate portion and a flat plate portion, the inclined plate portion being located on the inclined portion of said outer surface of the knife edge member with a junction between said inclined plate portion and said flat plate portion of said cover means being located substantially at said distal end of said knife edge member and said flat plate portion extending from said junction to contact said elastic sealing means.

2. The apparatus of claim 1 including the further improvement wherein the elastic covering means of said elastic sealing means comprises an inner elastic covering member and an outer elastic covering member, the covering members being deformable, the inner elastic covering member housing opposed frame members, said at least one spring means being disposed between said frame members, the outer covering member housing the inner covering member, the elastic sealing means further comprising gasket means disposed between portions of the inner and outer covering members, the gasket means being compressed therebetween by the spring means on closure of the door.

* * * * *